United States Patent [19]

Bice

[11] Patent Number: 4,858,388

[45] Date of Patent: Aug. 22, 1989

[54] RESTORATION OR DRILL BUTTONS

[76] Inventor: Keith C. Bice, Lot 2 Silvan Road, Hurstbridge, 3099, Victoria, Australia

[21] Appl. No.: 75,667

[22] Filed: Jul. 20, 1987

[30] Foreign Application Priority Data

Jul. 25, 1986 [AU] Australia ..... PH07142

[51] Int. Cl.[4] ..... B24B 11/00

[52] U.S. Cl. ..... 51/55; 51/73 R; 51/120; 51/125.5; 51/240 R; 51/288; 409/199

[58] Field of Search ..... 51/55, 73 R, 90, 119, 51/120, 125, 125.5, 218 A, 219 R, 240 R, 281 R, 288; 408/18; 409/132, 199, 200, 201, 216

[56] References Cited

U.S. PATENT DOCUMENTS

| | | | |
|---|---|---|---|
| 603,828 | 5/1898 | Dow et al. | 51/240 R |
| 1,114,376 | 10/1914 | Milkop | 51/43 |
| 2,836,939 | 6/1958 | White | 51/55 X |
| 3,020,681 | 2/1962 | Hite | 51/218 A X |
| 3,111,789 | 11/1963 | Harmon | 51/90 X |
| 3,797,177 | 3/1974 | Hoffman | 51/120 |
| 3,988,124 | 10/1976 | Babcock | 51/240 R X |
| 4,091,713 | 5/1978 | Kennedy | 409/200 |
| 4,245,939 | 1/1981 | Sear | 409/199 X |

FOREIGN PATENT DOCUMENTS

| | | |
|---|---|---|
| 67500 | 12/1984 | Finland . |
| 416115 | 12/1980 | Sweden . |
| 428541 | 7/1983 | Sweden . |
| 434356 | 7/1984 | Sweden . |
| 2008997 | 6/1979 | United Kingdom . |

*Primary Examiner*—Robert P. Olszewski

[57] ABSTRACT

Apparatus for restoring drill buttons or like objects includes a support body and structure for positioning a drive shaft rotatable about its axis. Bearing structure secures the structure to the support body for rotation about a second axis at an angle to the first axis. The two axes intersect at the location of a grinding burr mounted to the shaft for restoring a button in engagement with the burr. A transmimssion is provided for imparting rotational drive to the shaft positioning structure so that the first axis revolves about the second axis.

16 Claims, 5 Drawing Sheets

RESTORATION OR DRILL BUTTONS

BACKGROUND OF THE INVENTION

This invention relates to the restoration of drill bit buttons or like objects and has particular application to restoration of the tungsten carbide buttons set as a spaced array in the head of a button drill bit.

Restoration of a drill button entails the removal of metal around the button to expose more of the button, and the sharpening of the button so that it presents a rounded exposed end. A traditional approach is to mount the drill bit in an adjustable vice and then to polish the button with a grinder fitted with a concave diamond burr. A more recent innovation involves mounting the bit on a slowly rotating turntable under a rapidly rotating sharpening tool of pulley-like configuration. Swedish patent application 7701534-5 by Karlsson discloses substantially the converse of this concept, viz mounting the bit on a rapidly rotating turntable under a fixed, more conventional concave burr.

SUMMARY OF THE INVENTION

An object of the invention is to provide an improved method and apparatus for restoring drill bit buttons. In meeting this objective, the inventor has appreciated, firstly, that it is important to more closely approximate the complex motion traditionally achieved by manual handling of the grinder, and, secondly, that the idea of fixing the position of the drill bit, a feature of all prior techniques, should preferably be dispensed with.

The invention accordingly provides apparatus for restoring drill buttons or like objects, comprising:

a support body;

structure for positioning a drive shaft rotatable about a first axis being the axis of the shaft;

bearing means to secure said structure to said support body for rotation about a second predetermined axis at an angle to said first axis; and means for transmitting rotational drive to said structure whereby said first axis revolves about the second axis;

wherein said structure is such that said first and second axes intersect at the location in use of a grinding burr mounted to said shaft for restoring a button in engagement therewith.

The apparatus preferably further comprises means to transmit rotational drive to the shaft. The structure may be adapted to fixedly receive a power tool for providing and rotating said drive shaft. The structure may further include an asymmetrical annular component having mutually inclined end faces and being supported in said bearing means.

The support body preferably comprises an upright stand with a projecting bracket which carries said bearing means so that the second axis is vertical. The bracket is advantageously arranged to secure a power tool operably coupled to said drive transmitting means. Said tool mounting structure may include an annular plate assembly having an aperture for said shaft.

The apparatus preferably further includes a platform underlying said tool mounting structure and a carriage for a drill bit with buttons to be restored, which carriage includes means for securely holding the drill bit, and wheel means whereby the carriage is able to freely roll over said platform. Such means may comprise, e.g., wheels, castors or the like.

The invention also provides a method of restoring a drill button on a drill bit comprising:

securing the drill bit to a carriage with wheels, castors or like means;

resting the carriage on a surface over which it readily rolls if pushed or pulled;

engaging the button with a grinding burr held at a substantially fixed location; and both rotating and rocking the burr at that location to restore the button, the exact position of the button being responsively adjustable by rolling movement of the carriage on said surface.

The rotating and rocking is preferably effected by simultaneously rotating the grinding burr about a first axis and revolving said first axis about a second axis, said first and second axes intersecting at the location of the burr.

Still further provided by the invention is apparatus for restoring a drill button on a drill bit comprising:

a carriage rollably supported by wheels, castors or like means on an underlying platform surface, which carriage includes means for securely holding the drill bit; and means for mounting a grinding burr at a substantially fixed location and both rotating and rocking the burr at that location to restore the button.

PREFERRED EMBODIMENT

The invention will not be described, by way of example only, with reference to the accompanying drawings, in which.

Figure 1:
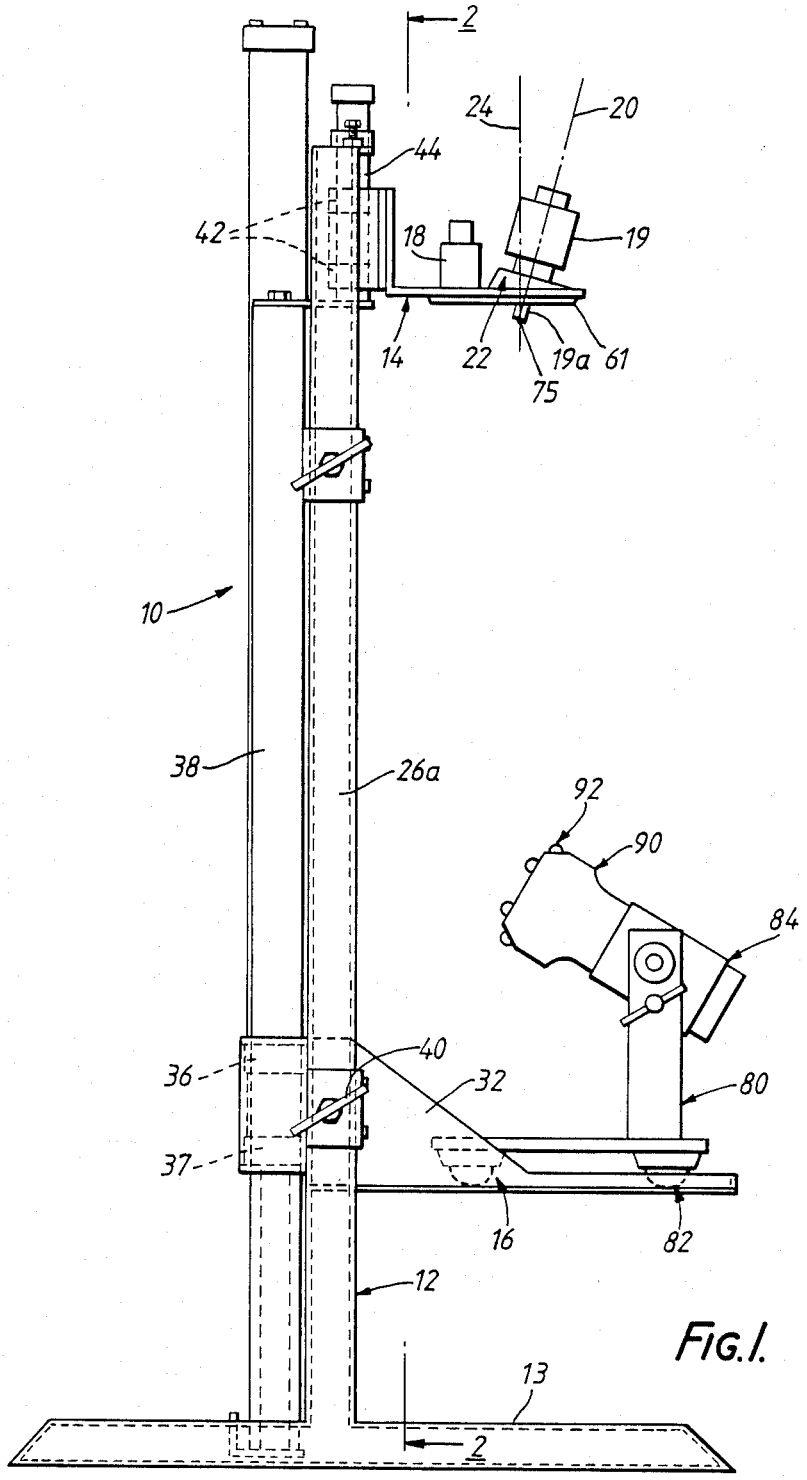
FIG. 1 is a side elevation of a first embodiment of apparatus according to the invention.
Figure 2:
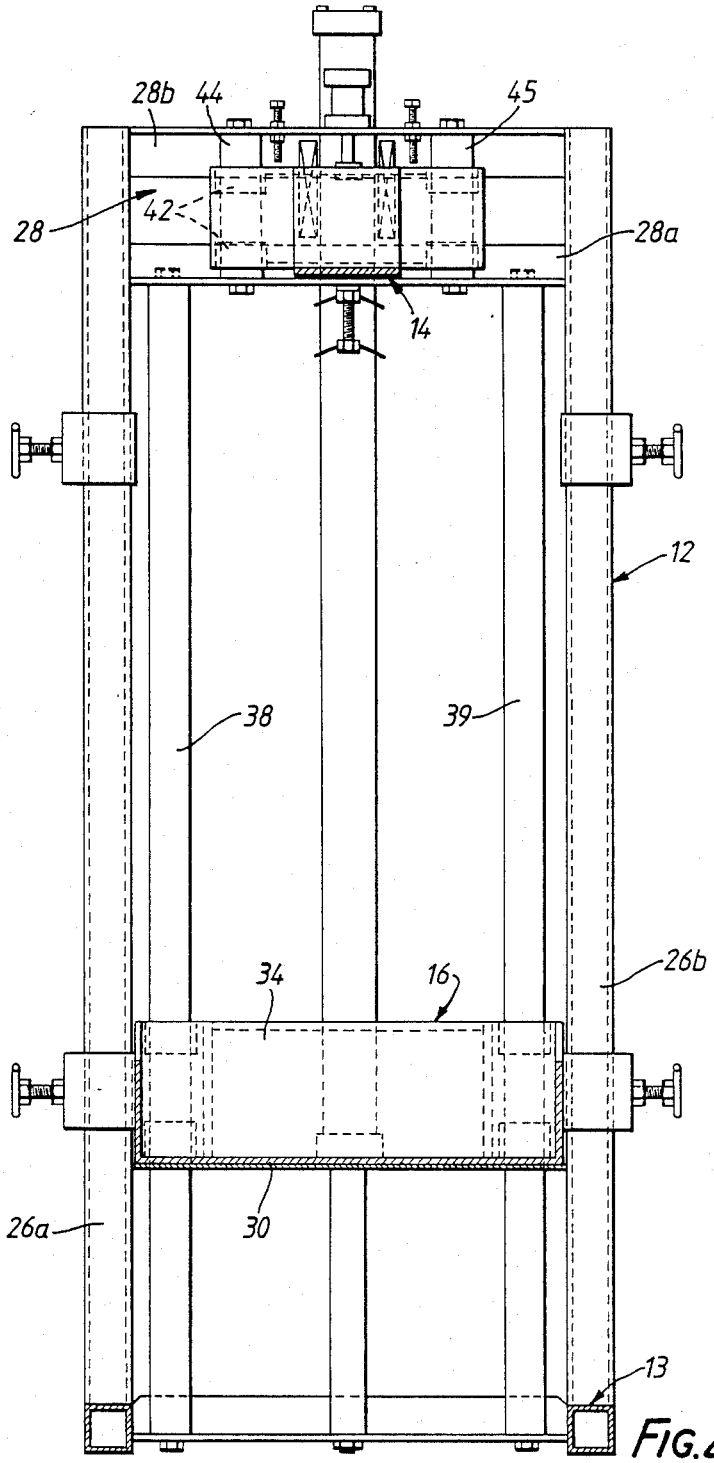
FIG. 2 is a vertical cross-section on the line 6—6 in FIG. 1.
Figure 3:
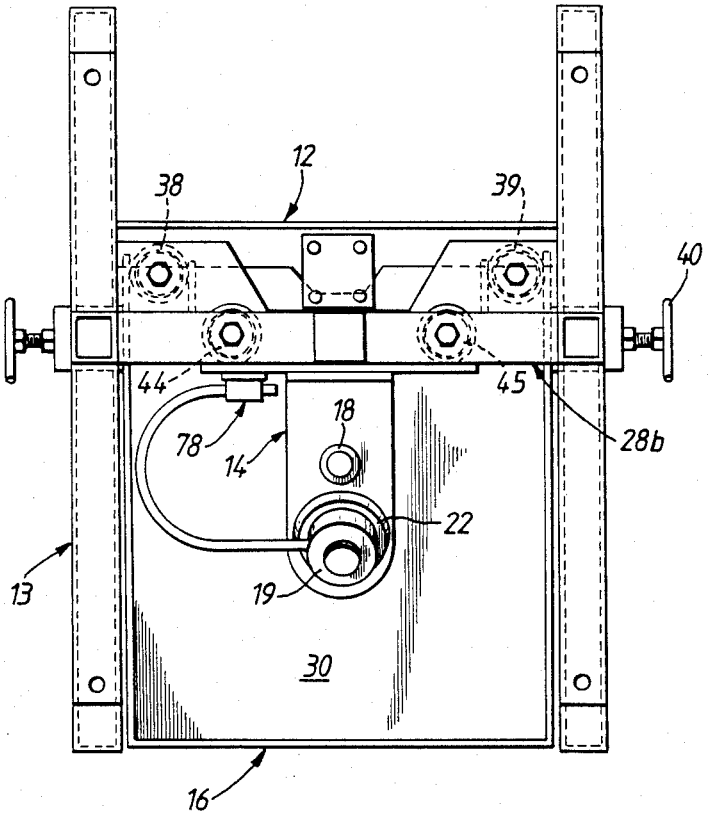
FIG. 3 is a plan view of the apparatus.
Figure 4:
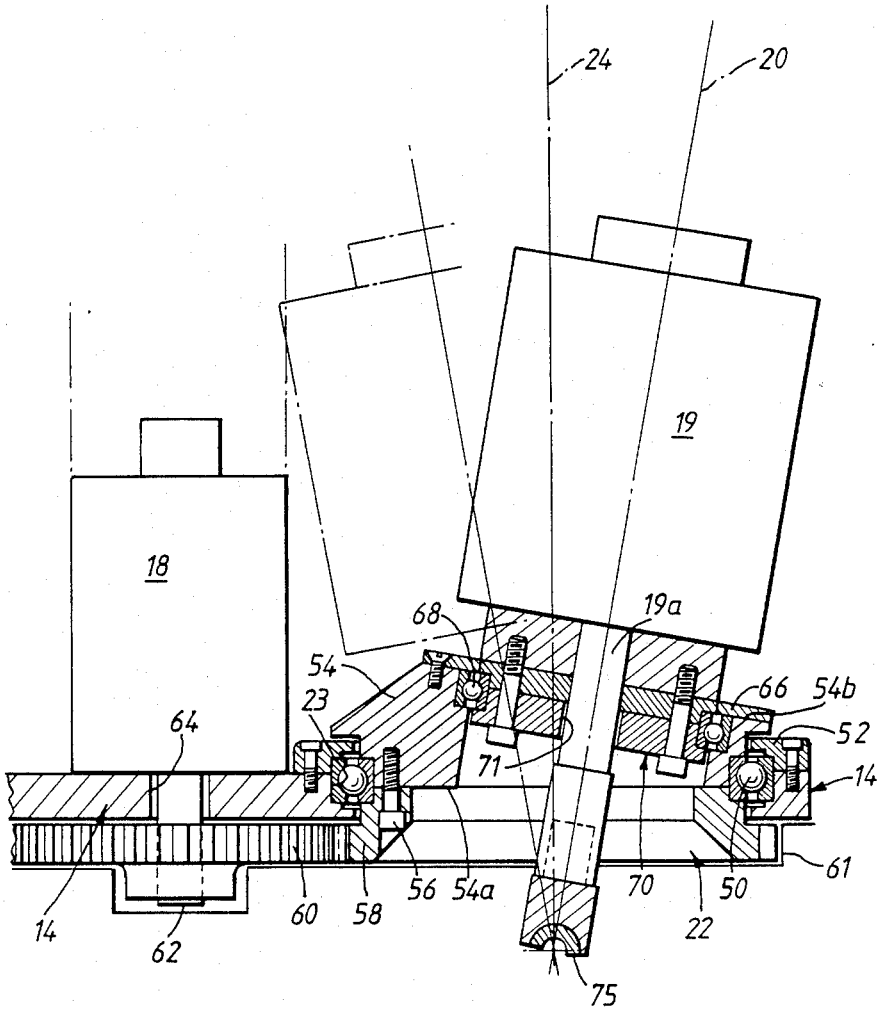
FIG. 4 is a sectional enlargement of part of FIG. 1.

The illustrated apparatus 10 includes an upright stand 12 which has a base 13 and carries an upper cantilevered right-angled bracket 14 and a lower platform 16 below the bracket. Bracket 14 in turn mounts a pair of power tools 18, 19, one of which (19) is secured, with the axis 20 of its drive shaft **19*a* inclined to the vertical, to annular structure 22 which is simultaneously rotatable by tool 18 about an upright axis 24**.

Stand 12 comrises a pair of spaced sturdy columns **26*a*, 26*b*, bridged by an upper pair of vertically spaced angle-section bars 28*a*, 28*b*, constituting a head 28 for the stand. Platform 16 has a floor 30, gusseted sides 32 and a back 34, and slides vertically by way of paired sleeves 36, 37 on respective upright tubular guides 38, 39. Guides 38, 39 extend between bar 28*a* and base 13. The platform can be fixed at a selected height by a pair of threaded locks 40 which engage columns 26*a*, 26*b***.

Bracket 14 also slides by way of paired sleeves 42 on short tubular guides 44, 45 secured between bars **28*a*, 28*b*. Tool mounting structure 22 is rotatably journalled within a large aperture 23 in bracket 14 in a ball bearing 50 retained by annular flange 52. Structure 22 includes an asymmetrical annular component 54 which defines spaced annular faces 54*a*, 54*b*** mutually inclined at 10°.

Face **54*a* is fixed by screws 56 to a large ring gear 58 whose teeth underlie the rim of aperture 23 and mesh with a complementary pinion 60. Pinion 60 has a stub socket 62 that projects through an aperture 64 in bracket 14 to be drivingly coupled to power tool 18 secured atop the bracket. Gears 58, 60 are covered by a suitable guard 61**.

Face 54*b* of structure 22 carries a retaining flange 66 for a further internal ball bearing 68 which journals a double plate assembly 70 bolted to power tool 19 so that the drive shaft 19*a* of the tool projects downwardly through an opening 71 in plate assembly 70. The axis 20 of shaft 19*a* is of course at 10° to the vertical and to the rotational axis 24 of structure 22. Tool 19 may, e.g., be a suitable commercial pneumatic grinder or router. In use, shaft 19*a* securely carries an interchangeable concave, indeed hemispherical, diamond grinding burr 75 and the arrangement is such that the intersection of axes 20, 24 co-incides with the centre of burr 75.

The power lead of tool 19, which may be, e.g., an air hose, is clamped to stand 12 at 78: this serves an important purpose to be noted shortly.

Platform 16 supports a carriage 80 which has multiple castors 82 and is therefore able to freely roll on the platform. Carriage 80 has a clamping arrangement 84 for securely receiving a drill bit 90 with multiple tungsten carbide buttons 92 requiring restoration.

By raising platform 16 and laterally rolling carriage 80, a selected button 92 is brought into firm polishing engagement with burr 75, which is of course selected to dimensionally complement the button. Both power tools are activated: tool 19 rotates the burr about shaft axis 20 at high speed, e.g. in the range 15,000–50,000 revs per minute to polish the button, while simultaneously axis 20 and the burr are precessed at low speed by tool 18 about axis 24, e.g. 30 to 100 revs per minute, to uniformly move the burr about the surface of the button. This precession is achieved by rotation of structure 22, which entails a rocking orbital motion of the tool 19. A very satisfactory symmetrical restoration of the button is achieved.

If desired, lubricating or cooling fluid may be continuously or intermittently supplied to the burr or to the shaft supporting it.

Because carriage 80 is free to roll on platform 16, the button is not rigidly secured with reference to the burr. A self-centering action is thereby achieved which further enhances the uniformity and balance of the restoration. It will also be seen that platform 16 can be used to raise heavy bits up to working height.

The vibrational torque of the orbiting tool 19 is coveniently taken up by the length of unrestrained power cable extending between the tool and clamp 78. This prevents the tool itself rotating; rocking motion is permitted by bearing 68.

OTHER EMBODIMENTS

Figure 5:
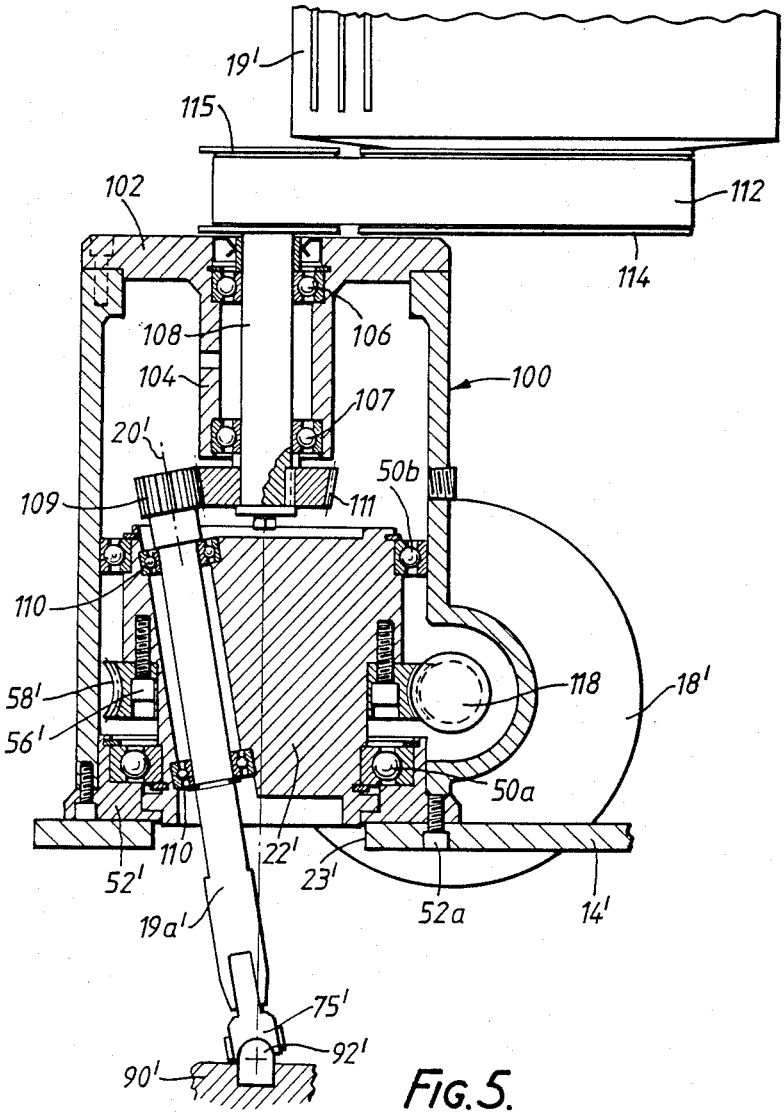
FIG. 5 is a sectional view similar to FIG. 4 of a second embodiment of apparatus according to the invention.

FIG. 5 depicts an alternative arrangement for rotating and rocking the burr 75. Bracket 14' again has a large aperture 23' through which the precessed shaft 19*a'* projects and mounts burr 75'. An annular flange 52' mounted by screws 52*a* to bracket 14' about aperture 23' retains one of two ball bearings 50*a*, 50*b* for a stepped cylinder block 22'. The other, upper bearing (50*b*) is adhered to the inside face of a tubular casing 100 upstanding from the bracket. Casing 100 is closed at its upper end by a head 102 having an integral depending boss 104 with bearings 106, 107 for a drive shaft 108.

Burr mounting shaft 19*a'* is rotationally supported, with its axis 20' at 10° to the vertical and to the axis 24' of the cylinder block 22', in bearings 110 within an inclined bore in the cylinder block. Above the block, it carries an integral spur gear 109 in meshing engagement with a tapered spur gear 111 on the bottom of shaft 108. Shaft 108 is rotated by a first electric motor 19' via a drive belt 112 and respective pulleys 114, 115 on the output shaft of motor 19' and on shaft 108. This motor thus rotates burr 75' on axis 20' via gears 109, 111 and shaft 19*a'*.

Shaft 19*a'* is precessed, and burr 75' thereby rocked as in the first embodiment, by means of a second electric motor 18' which rotates cylinder block 22' about axis 24' via a worm gear 118 in meshing engagement with ring gear 58' fixed by screws 56' to block 22'. It will be seen that the gear set 109, 111 acts as a simple planetary configuration for maintaining high speed rotational drive to shaft 19*a'* as the latter precesses about axis 24'.

I claim:

1. Apparatus for restoring drill buttons or the like objects, comprising:

a support body;

structure for positioning a drive shaft rotatable about a first axis being the axis of the shaft;

bearing means to secure said structure to said support body for rotation about a second predetermined axis at an angle to said first axis; and means for transmitting rotational drive to said structure whereby said first axis revolves about the second axis;

wherein said structure includes an asymmetrical annular component which is rotatably co-operable with said bearing means and has annular means normal to said first axis to position said drive shaft through said annular component along said first axis;

whereby said first and second axes intersect at the location in use of a grinding burr mounted to said shaft for restoring a button in engagement therewith, and said apparatus further comprising a platform underlying said structure and a carriage for a drill bit with buttons to be restored, which carriage includes means for securely holding the drill bit, and wheel means whereby the carriage is able to freely roll over said platform.

2. Apparatus according to claim 1 further comprising means to transmit rotational drive to said shaft.

3. Apparatus according to claim 1 wherein said annular component is adapted to fixedly receive a power tool for providing and rotating said drive shaft.

4. Apparatus according to claim 1 wherein said asymmetrical annular component has mutually inclined end faces in planes respectively normal to said first and second axes.

5. Apparatus according to claim 1 wherein said support body comprises an upright stand with a projecting bracket which carries said bearing means so that the second axis is vertical.

6. Apparatus according to claim 5 wherein said bracket is arranged to secure a power tool operably coupled to said drive transmitting means.

7. Apparatus according to claim 1 wherein said platform and said bearing means are relatively adjustable towards or away from each other.

8. Apparatus for restoring a drill button on a drill bit comprising:

a platform surface;

a carriage supported by wheel means on said platform surface so that the carriage readily rolls over said surface if pushed or pulled;

means on said carriage for securely holding the drill bit;

means for mounting a grinding burr at a substantially fixed location at which said drill button may be engaged with said burr; and means for both rotating and rocking the burr at that location when said button is engaged with said burr, whereby to restore the button, wherein the exact position of the button relative to the burr is responsively adjustable by rolling movement of the carriage on said surface.

9. Apparatus according to claim 8 wherein said means for mounting, rotating and rocking the burr comprises means to simultaneously rotate the burr about a first axis and to revolve said first axis about a second axis, said first and second axes intersecting at the location of the burr.

10. Apparatus according to claim 8 wherein said means for mounting, rotating and rocking the burr comprises a support body;

structure for positioning a drive shaft rotatable about a first axis being the axis of the shaft;

bearing means to secure said structure to said support body for rotation about a second predetermined axis at an angle to said first axis; and means for transmitting rotational drive to said structure whereby said first axis revolves about the second axis.

11. Apparatus for restoring a drill button on a drill bit, comprising:

burr mounting means for mounting a grinding burr at a substantially fixed location;

bit holding means for securely holding a drill bit;

support means supporting said bit holding means for readily responsive movement laterally in any direction with respect to the axis of a drill button on said drill bit; and means for both rotating and rocking said burr at said location when said button is engaged with said burr, whereby to restore the button, wherein the support means is such that the exact lateral position of the button relative to the burr is responsively adjustable by lateral movement of the bit, whereby to provide self-centering of the button with respect to the burr.

12. Apparatus according to claim 11 wherein said means for rotating and rocking the burr comprises means to simultaneously rotate the burr about a first axis and to revolve said first axis about a second axis, said first and second axes intersecting at the location of the burr.

13. Apparatus according to claim 11 wherein said means for mounting, rotating and rocking the burr comprise:

a support body;

structure for positioning a drive shaft rotatable about a first axis being the axis of the shaft;

bearing means to secure said structure to said support body for rotation about a second predetermined axis at an angle to said first axis; and means for transmitting rotational drive to said structure whereby said first axis revolves about the second axis.

14. A method of restoring a drill button on a drill bit comprising:

securing the drill bit to a carriage with wheel means;

resting the carriage on a surface over which it readily rolls if pushed or pulled;

engaging the button with a grinding burr held at a substantially fixed location; and both rotating and rocking the burr at that location to restore the button, the exact position of the button relative to the burr being responsively adjustable by rolling movement of the carriage on said surface.

15. A method according to claim 14 wherein said rotating and rocking is effected by simultaneously rotating the grinding burr about a first axis and revolving said first axis about a second axis, said first and second axes intersecting at the location of the burr.

16. A method of restoring a drill button on a drill bit, characterised by securing the drill bit to a support which is readily responsively moveable laterally in any direction with respect to the axis of the drill button to be restored, engaging the button with a grinding burr held at a substantially fixed location, and both rotating and rocking the burr at said location to restore the button, the exact lateral position of the button relative to the burr being responsively adjustable by lateral movement of the bit, whereby to provide self-centering of the button with respect to the burr.

* * * * *

UNITED STATES PATENT AND TRADEMARK OFFICE

CERTIFICATE OF CORRECTION

PATENT NO. : 4,858,388
DATED : August 22, 1989
INVENTOR(S) : Keith C. Bice

It is certified that error appears in the above-identified patent and that said Letters Patent is hereby corrected as shown below:

In the title, "RESTORATION OR DRILL BUTTONS" should read --RESTORATION OF DRILL BUTTONS--.

Col. 2, line 29 "not" should be --now--.

Col. 2, line 61 "journalled" should be --journaled--.

Col. 3, line 48 "co-" should be --con--.

Col. 6, claim 13, line 11 "prise:" should be --prises:--.

Signed and Sealed this

Ninth Day of October, 1990

*Attest:*

HARRY F. MANBECK, JR.

*Attesting Officer*

*Commissioner of Patents and Trademarks*